United States Patent [19]

Meschi

[11] Patent Number: 4,618,340

[45] Date of Patent: Oct. 21, 1986

[54] APPARATUS FOR THE RECEIVING PACKING AND TRANSFERRING OF SHEET MATERIAL

[76] Inventor: Luciano Meschi, Corso Amedeo 73, 57100 Livorno, Italy

[21] Appl. No.: 491,412

[22] Filed: May 4, 1983

[51] Int. Cl.[4] ..... B05B 1/14

[52] U.S. Cl. ..... 493/13; 493/22; 493/357; 493/412; 225/103

[58] Field of Search ..... 493/412, 410, 411, 413, 493/414, 415, 13, 14, 22, 33, 27, 12, 11, 10, 28, 23, 357, 356, 372; 414/50, 46; 271/218, 192, 189; 225/103, 104, 100, 101; 83/697, 380, 386, 376, 363; 226/25

[56] References Cited

U.S. PATENT DOCUMENTS

| | | | |
|---|---|---|---|
| 2,244,550 | 6/1941 | Chandler | 83/386 |
| 3,301,111 | 1/1967 | Nystrand | 83/92 |
| 3,352,553 | 11/1967 | Preston | 270/79 |
| 3,395,916 | 8/1968 | Dobson | 271/88 |
| 3,640,521 | 2/1972 | Hutley | 493/412 |
| 3,684,275 | 8/1972 | Schweitzer et al. | 493/413 |
| 3,704,820 | 12/1972 | Frederick | 226/34 |
| 3,877,627 | 4/1975 | Boase | 226/33 |
| 4,183,704 | 1/1980 | Steinhart | 414/31 |
| 4,205,836 | 6/1980 | Nystrand | 493/430 |
| 4,227,683 | 10/1980 | Spangler et al. | 493/27 |
| 4,358,285 | 11/1982 | Fujino | 493/411 |

FOREIGN PATENT DOCUMENTS

| | | |
|---|---|---|
| 1804909 | 8/1969 | Fed. Rep. of Germany . |
| 2701992 | 7/1978 | Fed. Rep. of Germany . |
| 2712588 | 9/1978 | Fed. Rep. of Germany . |
| 1371722 | 7/1964 | France . |
| 2077700 | 2/1970 | France . |
| 2145934 | 1/1973 | France . |
| 681367 | 10/1952 | United Kingdom . |
| 1509627 | 5/1978 | United Kingdom . |
| 2073716 | 10/1981 | United Kingdom . |

OTHER PUBLICATIONS

IBM Technical Disclosure Bulletin, vol. 19, No. 1, Jun. 1976, New York, U.S.A., J. H. Hubbard et al.: "Copier Controls", pp. 8, 9.

*Primary Examiner*—Francis S. Husar
*Assistant Examiner*—Robert Showalter
*Attorney, Agent, or Firm*—McAulay, Fields, Fisher, Goldstein & Nissen

[57] ABSTRACT

Apparatus for receiving and forming a cut pile of sheets which are received in joined form from a processing station, and includes a dragging device to control the feed of the joined sheets, a guide to move the uncut sheets past a cutting mechanism in an accordian-like fashion, and a plate to receive the cut pile of sheets; and a temporary support and separator between the receiving plate and the guide to provide for the cutting of the sheet material in pre-fixed sheet lengths.

31 Claims, 6 Drawing Figures

31
35
32
17
17
44
42
38
53
38
43
42
44
50
39
50
50
51
50
50'
49
34
88
33
81
90
87
87

APPARATUS FOR THE RECEIVING PACKING AND TRANSFERRING OF SHEET MATERIAL

BACKGROUND OF THE INVENTION

The present invention concerns an apparatus suitable for receiving and transferring sheet materials, joined to each other as a continuous strip and tearable or severable for example such as the forms processed or used in data processing centers.

In recent years ever growing diffusion has been acquired by electro-accounting and data processing systems, such as electro-accounting stations associated with computers, wherein preformed forms (eventually previously hollow-punched for the so-called self-enveloping types) are processed by the printing machines, especially fast printing machines such as the so called laser printers, the forms being fed to the printing machine from form packages united as a continuous strip and folded in accordion like manner.

After the processing by the printing machine, the forms are again accordion-like refolded into packages and subsequently separated into single forms by use of weakening or tearing lines between each form and the adjacent ones. To date the forms as processed by the printing machine were collected into packages corresponding to similar packages in the feeding station which were manually transferred to successive operations, with evident waste of time and manpower. Since new fast printing machines, for example laser printers, came into use, a package consisting of one thousand or more forms is exhausted within a few minutes, whereby it is thus manifest that down times both in the loading of a new form package and in the removal of the already processed form package will heavily affect the production rate of the printing machine and hence of the data processing center.

As regards the feeding stage of the forms to the printing machine, the problem has been faced and solved by means of apparatus for the automatic splicing of the last form or sheet (i.e. the "tail" of the form strip) of a package of forms (in particular that one which is still being fed to a printing machine), with the first form or sheet (i.e. the "head" of the aforestated strip) of a subsequent package so that exhaustion of the package being fed does not cause any interruption of the feeding and thus of the operation of the printing machine.

SUMMARY OF THE INVENTION

The main purpose of the present invention is that of providing an apparatus by which:

the strip of sheets or forms coming out of the printing machine is received and folded in an accordion-like manner forming a package containing a prefixed number of sheets;

the strip is cut after the desired and predetermined number of sheets or forms has been piled up in the package being formed;

the thus formed package is removed, the cutting and removing operations of the package of forms and sheets are carried out without interferring with the oncoming strip of sheets and forms, the piling up of which continues undisturbed with an accordion-like folding;

the drawbacks occurring in forms and sheets due to the transfer through the printer and/or other machines are overcome.

Another just as important purpose of the present invention is to provide an apparatus having the aforestated characteristics and the utmost operating reliability and having operative rates which are controllable and consistent with the operating rates of equipments positioned upstream of the apparatus itself, and particularly with those of the laser printing devices.

These and other purposes are achieved by means of a receiving, packaging and transferring apparatus for sheet materials arriving to the apparatus as a continuous strip, wherein the single sheets are reciprocally separated by lines of weakness to provide for tearing or separation of adjacent continuous strips from each other characterized by comprising a dragging device suitable for the dragging in a controlled manner of the oncoming strip of sheets, guiding means by which said strip of sheets is received and directed in a vertical direction onto a receiving plate, means for temporarily holding said strip which is deposited in an accordion-like manner onto said plate, end guiding means engageable with two opposed edges of the strip for their guidance to the desired position, said edges being defined by transverse foldings in said strip, temporary separation means which can be interposed in the sheet package being formed by the strip being folded, temporary supporting means which can be interposed in the said sheet package below and parallelly with respect to said separating means, cutting blade means engageable with one of said edges simultaneously with the operation of said temporarily supporting means, first detecting means for detecting the presence of said strip in said dragging device, second detecting means for measuring and counting the length of said strip passing through said dragging device and third detecting means for signalling the piling up level of said strip accordion-like folding onto said receiving plate and transporting means for removing the package of sheets formed on said receiving plate after the actuation of said cutting means.

The specific features and advantages of the present invention will appear more clearly from the following description, with reference to attached drawings, of a preferred embodiment.

It is obviously to be understood that the reference to printing machines of a data processing center, which represent the preferred field of use of the invention, is not intended to have any limiting purpose, but only shows an exemplifying use of the apparatus of the invention.

DESCRIPTION OF THE PREFERRED EMBODIMENT

Figure 1:
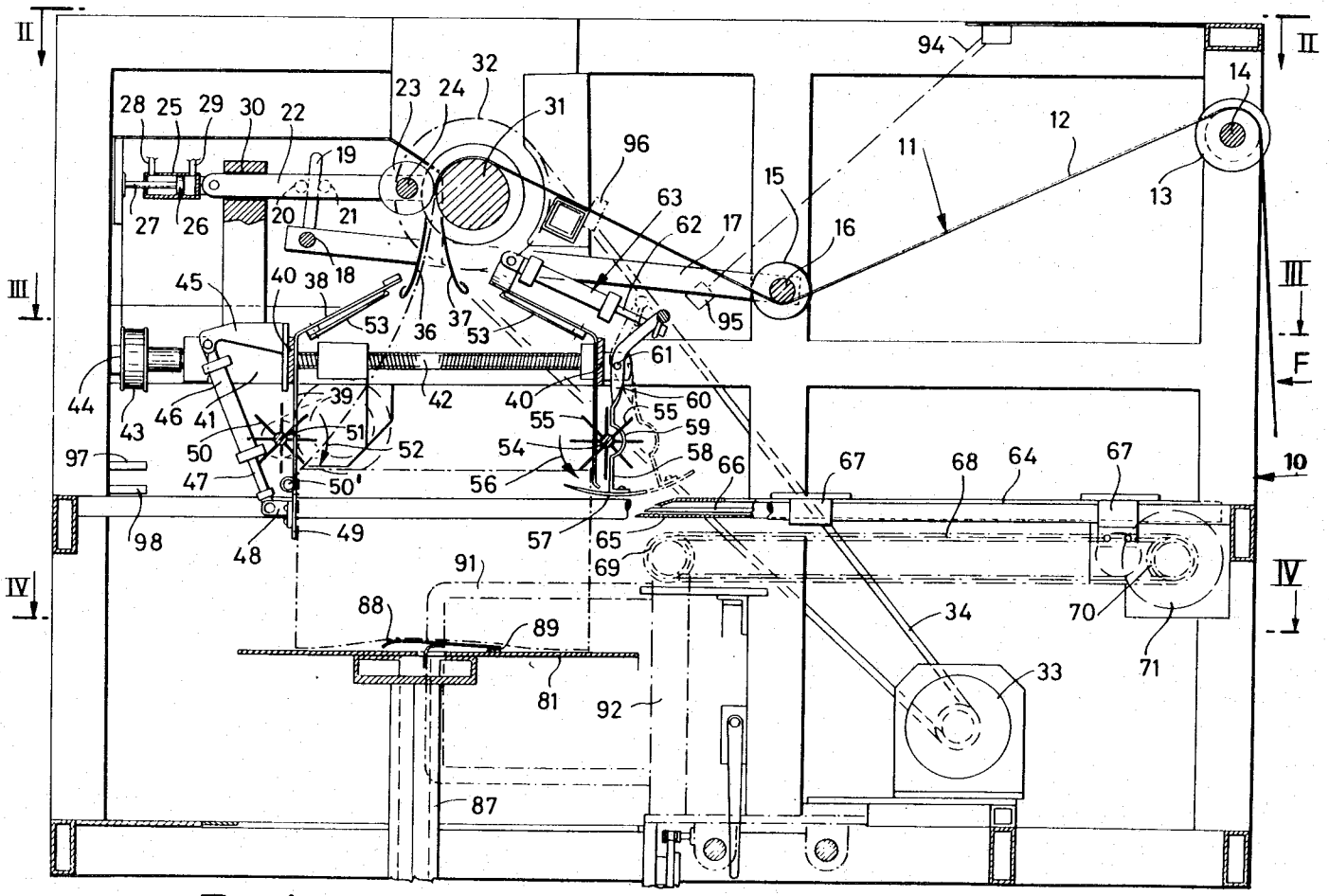
FIG. 1 is a diagrammatic, partially cross-sectional side view of the apparatus in accordance with the invention.
Figure 2:
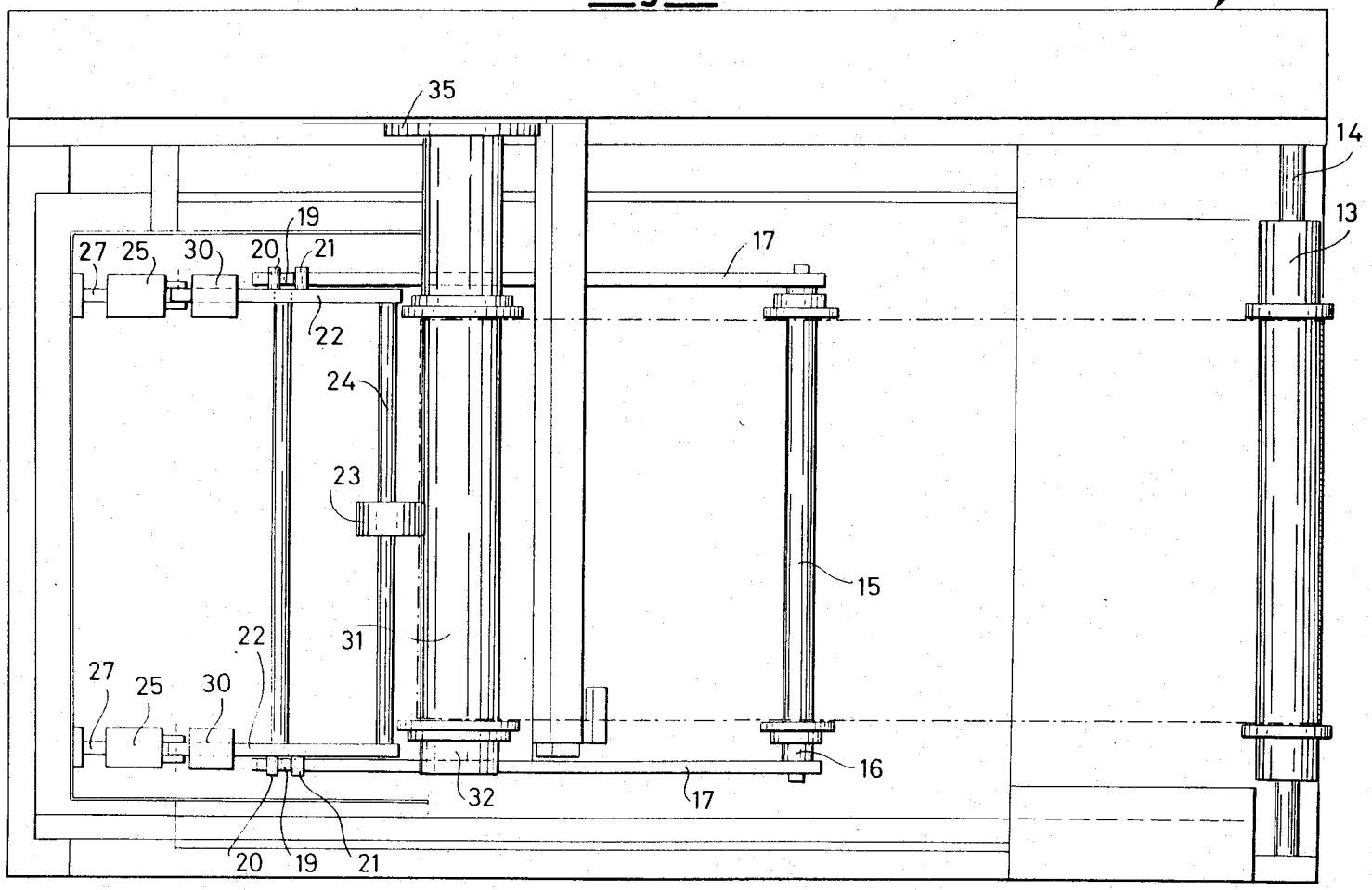
FIGS. 2, 3 and 4 are horizontal cross-sectional views along the lines II—II, III—III, and IV—IV of FIG. 1, respectively.

Referring to the drawings, the apparatus of the invention includes a frame, having vertical and cross members, generically indicated by reference number 10.

The paper strip 11, consisting of forms or sheets 12 joined to each other as a continous strip and defined by preformed cutting or tearing lines, enters the apparatus by passing on an idle roller 13 journalled to a shaft 14.

In the path of movement of the strip 11 there is inserted an idle tension roller 15, mounted on a pin 16 the ends of which are pivotally mounted on the ends of two arms 17 of a rocker regulating assembly, the arms 17 being journalled to the frame 10 at the pins 18.

The arms 17 define one portion of a bell crank lever fulcrumed at 18, the second portion 19 of which is positioned in a space formed between two relieved parts 20,21 and engages therewith, the parts 20,21 being formed on a rod 22, said rod carrying at one of its ends a friction roller or cylinder 23 pivotally mounted on a rod 24, whereas the other end of the rod 22 is secured to a cylinder 25 slidingly mounted onto a piston 26, the stem 27 of which is secured to the frame 10.

The cylinder 25 includes two ports 28,29 so that it is of the double-acting type. The rod 22 is guided along its horizontal sliding movement by a fixed guide 30 of rectangular cross-section, so that the rod having a corresponding cross-sectional shape is prevented from rotating but can only axially slide.

The roller 23 defines together with the roller 31 journalled to an axle or shaft 32 a roller feeding group having the purpose of feeding the strip 11 coming from the roller 13 by passing it below the stretching or idle tension roller 15 and which is self-controllable as it will be explained hereinafter.

Drive means 33 operate, through the drive chain 34 and the pinion 35 which is keyed to the axle or shaft 32, of the roller 31.

Below the nip of the rollers 31 and 23 there is vertically aligned a flared guide formed by two plates 36,37 defining the angle of variation of the vertical positioning of the strip being dragged by the dragging device.

The flared lower outlet of the guide (36,37) opens towards a piling up and collecting area which is upwardly defined by two inclined planes consisting of inclined bars 38, which are extended by vertical bars 39, the bars 38 and 39 being joined so as to form a cage of substantially pentagonal cross-section, by means of horizontal tie bars 40, fixed to end blocks 41, having an axial and threaded hole, which are engaged by bars 42 each having two symmetrical oppositely screw threaded portions acting as worm screws.

Figure 3:
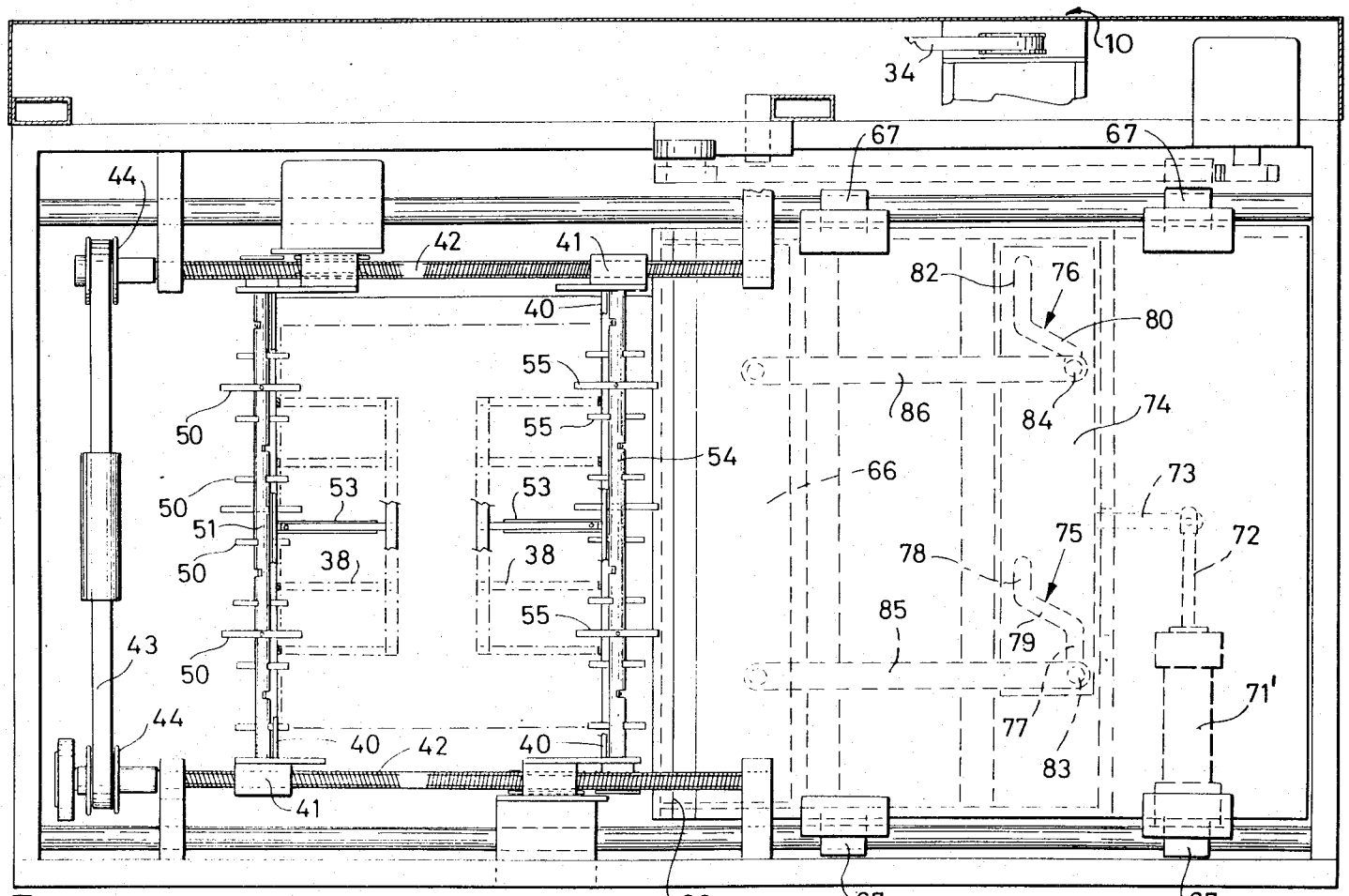

As seen in FIG. 3, rotation of bars 42 by means of drive belt 43 engaging pulleys 44, causes the pairs of blocks 41 mounted on the bars 42 to approach to and remove or separate from each other in a synchronized manner and by equal spaces. Consequently, the approaching and separation of the tie bars 40 takes place so that the width of the pentagonal cage may be adjusted as a function of the size of the single sheets or forms 12.

The right hand bar 40, as seen in FIG. 1, has secured thereto a bracket 45 to which there is anchored the cylinder 46 of a cylinder and operating piston assembly, the stem 47 of the piston being pivoted at its free and outer end to a bracket 48 secured to a swing plate 49 pivotally mounted to a pin 50', to which the lower ends of the vertical bars 39 are secured.

Consequently the extension and the reverse motions of the stem 47 cause the swinging plate 49 to rotate between the vertical position, in which it is aligned with the vertical plane as defined by the bars 39, and a reverse position in which the swinging plate is outwardly rotated by 90° (or more), so that no obstacle exists below the horizontal plane defined by the lower ends of bars 39.

Blades 50, supported by a shaft 51, pass between the bars 30, the shaft 51 rotating in the direction of the arrow 52 (FIG. 1). Obviously also the ends of the shaft 51 are fastened to the blocks 41 so that the position of the shaft 51 is adjustable at the same time as that of the bars 40.

The blades 50 are staggered by suitable angles around the shaft 51, so that each blade (or a group of blades which are distributed or angularly spaced around the longitudinal axis of shaft 51) engages the strip coming from the guide 36,37 and accompanies its folding according to the already existing folding lines of the like package at the feeding section of the printer.

The blades 50 are flexible with a predetermined flexibility degree and are preferably of a plastic material resistant to repeated folding or bending. If necessary, the action of blades 50 may be helped by nozzles or nozzle bars, located at the two inclined walls defined by the bars 38, which are alternately operated to deliver a downwardly directed air jet, suitably inclined so as to accompany the strip coming from the roller feeding device.

The bars 38 are moreover provided with symmetrically positioned microswitches 53 the function of which shall be explained hereinafter. Another shaft 54 is symmetrically provided with reference to the vertical plane passing by the nip of the rollers of the roller feeding device, said shaft carrying blades 55, similar to blades 50 and rotating in the direction of the arrow 56, with the same function as those of the shaft 51.

A temporary separation plate or panel 57, movable between positions shown by full and dotted lines in FIG. 1, is provided in correspondence with the shaft 54. The plate 57 is carried by arms 58, having a suitable curvature, shown by reference 59 so as not to interfere with the shaft 54, the arms 58 being upwardly secured to a tie bar 60 pivotally mounted at 61 to the frame.

The upper end of the tie bar 60 is fixed to the free end of a stem 62 of the piston of a cylinder-piston assembly or jack, generally indicated by reference 63 and which is secured to the frame 10 for the displacement of the plate 57 between the two aforesaid positions.

The plate 57 is suitably curved and downwardly tangent to the plane defined by the upper surface of a temporary separation and cutting plate, shown by 64. The plate 64, together with a lower plate 65, defines a housing for a cutting blade 66, the assembly formed by the plates 64 and 65 being movable between a rest position shown in FIG. 1 and an operating position, in which the edges of the plates 64 and 65, provided with the chamfered portions shown in FIG. 1, abut against the swinging plate 49.

For carrying out the displacement of plates 64 and 65, the latter are secured, via blocks 67, to conveying chains 68 passing around toothed pinions 69 and 70, the latter one being driven by a motor 71.

For the operation of the blade 66, there is provided a mechanism comprising an operating jack 71', the rod 72 of which is rigidly secured, by means of the bell crank arm 73, to a plate 74 including two slots 75 and 76, the first of which comprises two portions 77,78 parallel to the extension direction of the stem 72, and an inclined portion 79, while the slot 76 comprises an inclined portion 80 parallel to the portion 79, and a portion 82 parallel and aligned with the portion 78 of the slot 75. Within the slots 75 and 76 there are seated the pins 83 and 84, slidable along the slots themselves without the possibility of disengaging therefrom, the pins being fixed to the ends of two actuating bars 85 and 86, which at the other end are rigidly fixed to the blade 66.

The plate 74 is connected with the outer end of arm 73 and plate 74 is also horizontally slidable in a direction perpendicular to the displacement direction of bars 85 and 86 of blade 66.

Plate 74 has a width less than the overall width of the blade 66. When rod 72 of the piston assembly is withdrawn, plate 74 is displaced and acts through slots 75 and 76 on pins 83 and 84, and this causes bars 85 and 86 to be forwardly displaced.

Consequently, the return movement of the rod 72 of the jack 71' causes the plate 74 to be displaced and thus the out of phase engagement of the pins 83 and 84 with the inclined portions 79 and 80 of slots 75 and 76 respectively, whereby the blade 66 is caused to advance until coming out of the slit formed between the tapered edges of the plates 64 and 65.

The lack in the slot 76 of an initial portion corresponding to the portion 77 of the slot 75 shall cause the blade to be inclined so that the part thereof corresponding to the slot 76 will beforehand protrude from said slit, the cutting action being thus of the "paper-knife" type.

This result can also be achieved by means of a blade having an inclined edge directly actuated for carrying out the cutting operation.

In turn, two equivalent portions 78 and 82 of the slots 75 and 76 provide for the completion of the cutting action as the blade is substantially straightened and brought again into a position parallel to the starting one.

The reverse displacement of the rod 72 of the jack will obviously restore the blade into the starting condition.

Figure 5:
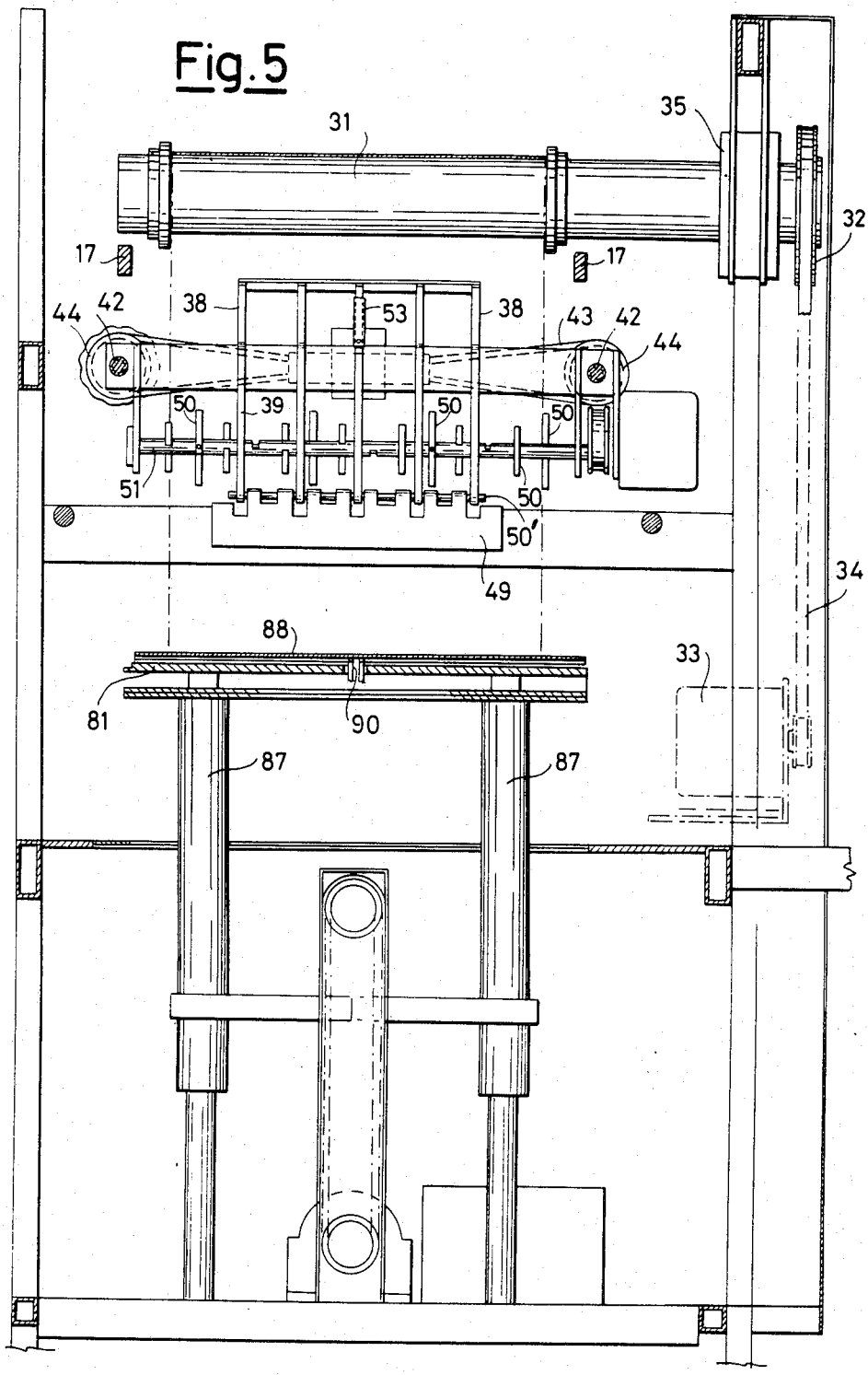
FIG. 5 is a view of the apparatus of FIG. 1 in the direction of the arrow F in FIG. 1.
Figure 6:
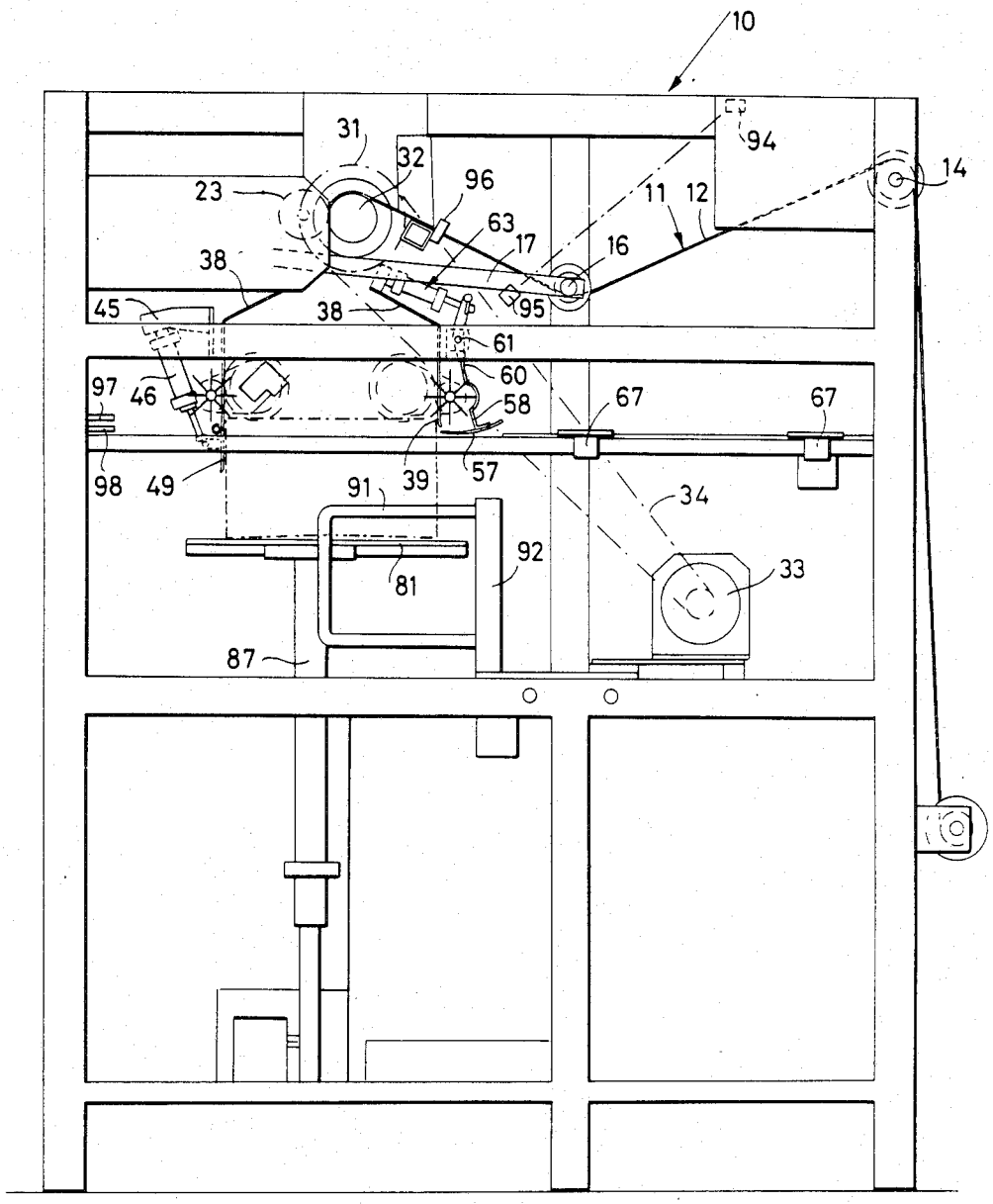
FIG. 6 is a view similar to FIG. 1 showing the apparatus of the invention in a different operating condition.

It will be noticed from FIG. 3 that the assembly consisting of the blade and of the actuating mechanism is integrally displaced together with the plates 64 and 65. The sheet strip coming from the roller feeding device is received onto a plate 81, vertically movable in a controlled manner, plate 81 being fixed at the upper end of the cylinders 87 of two actuating jacks (FIG. 5).

Onto plate 81 there is pivotally mounted a curved panel 88, rotatable around the axis 89 and of material (e.g. metal sheet) having a predetermined flexibility so that when charged with a prefixed load the panel is straightened, wholly abutting onto the plate 81 and operating a micro-switch 90 (or a pair of micro-switches 90 parallelly provided for safety reasons) for the hereinafter stated purposes.

Figure 4:
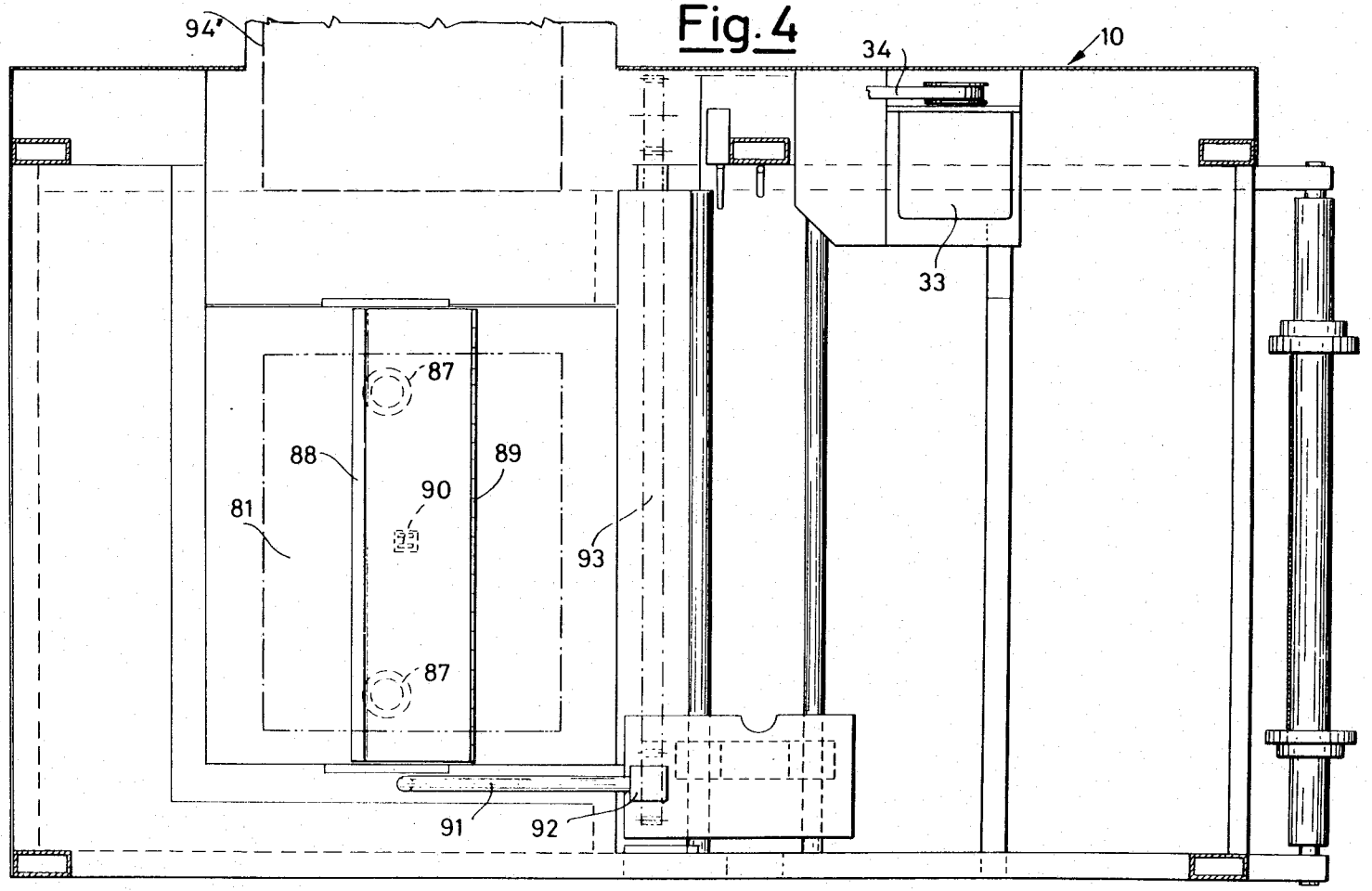

Lastly the frame 10 has secured thereto a transfer mechanism comprising an arm 91 shaped as a closed polygon, the width of which is less than that of the final package to be transferred, said arm being mounted to a vertical rod 92, reciprocally movable by means of chains 93, driven by motor means between the position shown in FIG. 4 and an end-transfer position wherein the package piled up onto the plate 81 is displaced to the position shown by dotted lines and with the reference number 94' in FIG. 4.

For the control of the operating functions of the apparatus of the invention, detection and control means are provided comprising a paper strip presence detector in the dragging device, said detector being formed by an assembly comprising the photoelectric cell 94 and a receiver 95, whereby the beam emitted by the cell 94 will be intercepted by the strip 11.

By reference number 96 there is shown a device for detecting and measuring the length of the strip 11 passing through the roller feeding device and, after all, the number of sheets piled up onto the plate 81 to form a package.

In the preferred embodiment of the invention, the device 96 consists of a known-type detector by which the lateral holes normally provided in the forms processed in data processing centers is counted and divided by a constant factor corresponding to the number of holes provided in each form.

Lastly by numbers 97 and 98 there are indicated two level detectors, normally in form of photoelectric cells, having the following functions:

(a) the cell 97 serves to indicate that the maximum level of paper has been attained during the package formation and causes a programmed lowering of the receiving plate to take place, forming at the same time a safety device agaist the raising of the plate 81 carrying the already formed package;

(b) the cell 98 serves as a fixed reference level for the lowering of the receiving plate 81 needed for the insertion of plate 57 and then subsequently of the plates 64 and 65.

The operation of the apparatus according to the present invention takes place in the following manner.

The strip 11 is caused to pass around the roller 13 and under the stretching roller 15, being then inserted in the roller feeding device, i.e. between the cylinder 31 and the cylinder 23.

The actuation of the motor of the cylinder 31 causes the advancing movement of the strip to take place, and the strip obviously comes from a printing machine (not shown) at the operating rate of the such printing machine. Accordingly the feeding rate will be adjusted on the basis of the operating rate of the printing machine.

The stretching roller 15 will thus take a balance position and, in the case of stopping of the printer and/or of the apparatus of the invention, it will allow for the return towards the printing machine of a length of strip 11 corresponding to the length of the strip that the printer, owing to the intrinsic operation characteristics thereof, takes back each time it stops.

In other words, when the printer or the receiving apparatus (e.g. due to a jamming) stops, actuating fluid is fed to the port 28 of the cylinder 25, so that the rod 22 is returned towards the cylinder itself (in the left direction in FIG. 1), thus giving place to the counterclockwise rotation of the arm 19 around the pin 18 and to the raising of the stretching roller 15.

If, on the contrary, during the apparatus operation a difference should exist between the operation rate of the roller feeding device and the operating rate of printer (and thus the oncoming rate of the strip 11 towards the roller 14) the position of the stretching roller 15 will change (by being raised or lowered); consequently the arm 19 will act onto the relieved parts, 20 or 21, respectively, causing the pressing roller 23 to be displaced. Accordingly the nip between the roller 23 and the cylinder 31 will be changed to a lower or greater feeding rate, and will be thus self-adjusted and adapted to that of the coming strip and then, after all, to the operating rate of the printer.

The strip from the roller feeding device passes to the space defined by the guides 36 and 37.

Since the strip comes out from a package in which it was already folded as an accordion and due to the fact that the passing through the printing machine does not eliminate such a configuration of the strip, the latter will tend to be deposited onto the plate 81 with a like configuration, it being helped also by the engagement with the blades 50 and 55 alternatively, by which the foldings or edges of the strip are engaged at the time they take again their configuration.

At the beginning of the piling up of the strip 11 onto the plate 81, the latter will be positioned at its uppermost position and, as the layer of sheets increases or grows onto the plate 81, the photoelectric cell 98 is actuated, by which a prefixed lowering of the plate 81 is controlled. In the meantime the number of sheets or forms which are in this way piled up in a package arrangement is counted by the detecting device 96 and compared with a predetermined value set in the electronic network of the apparatus. Upon the prefixed number of sheets being reached, the jack 63 is actuated and the separation panel 57 is rotated to the operative position shown by full lines in FIG. 1 so that the edge of the immediately next sheet being deposited abuts onto the upper face of the panel 57 it being thus separated from the immediately preceding one.

Within the growing or increasing package there is thus formed an opening within which the assembly formed by the two plates 64 and 65 also carrying the cutting blade device can be inserted. The switching on of the motor 71 causes the advancement movement of the assembly of the two plates 64 and 65 which stop against the swing plate 49 which in the meantime has been rotated downwardly (i.e. towards the position shown in FIG. 1), owing to the actuation of the cylinder and piston assembly 46, 47. The rotating action of the panel 57 does also permit that the assembly formed by the plates 64, 65 together with the chamfered edge formed therefrom in the front part to exactly fit the folding between the two sheets respectively positioned directly below and directly above with respect to the panel 57 and thus also with respect to the plates 64 and 65. The profile of the front edges of plates 64, 65 is furthermore shaped so as to ensure that the blade 66, upon coming out from the front slit between the plates 64, 65, does exactly engage the folding edge between the two above mentioned sheets.

By actuating the jack 71', the blade 66 is operated as previously described while the strip 11 continues to pile up onto the upper face of the plate 64.

It should be pointed out that, before the actuation of the blade 66, the plate 81 is raised so that the sheets already piled up onto plate 81 to form the desired package are made compact before the cutting operation, the package itself thus taking the desired shape and compactness in order to obtain a clear cut, and no dragging of the sheets by the blade occurs before the cutting operation is started or even only completed.

Obviously the actuation of the blade 66 is preceeded by the actuation of the cylinder and piston assembly 46, 47 to outwardly rotate and thus disengage the swing plate 49 which otherwise would hamper the blade action.

When the cutting operation is completed the plate 81 is lowered again to the initial position at which the arm 91 by sliding along with the chain 93 removes the finished package.

The cutting blade acts in the manner of a paper knife. In the embodiment shown in the drawings, such as action is obtained (see FIG. 3) by means of the jack assembly 71', 72, 73 acting onto the blade 66 through the actuating bars 85 and 86, having the pins 83 and 84 slidingly guided into the slots 75 and 76 formed in the fixed plate 74.

Consequently, when the jack assembly is actuated so as to extend the rod 72, the edge of the blade 66 in the portion corresponding to the slot 76 will be more protruding than the portion corresponding to the slot 75, whereby the blade 66 will take a forwardly inclined configuration.

When the pin 84 has taken the position 84' and the pin 83 the position 83', the edge of the blade 66 takes the inclination shown by reference X, which means that the edge of the folded strip to be cut is engaged by the blade 66 acting, as already mentioned, in paper knife manner by which the cutting of the paper is clearly made easier.

At the end of the displacement of the pins 83 and 84 along the slots 75 and 76 respectively, the edge of the blade 66 will again be parallel to the initial position, whereby the completion of the cutting action is ensured.

Then the plate 81 returns to the uppermost position (into contact with the plate 65) and the assembly formed by the plates 64 and 65 (between which the blade 66 has already been retracted by actuating the jack 71) is retracted too.

Similarly the panel 57 is retracted due to actuation of the jack 63 and the process starts again by the lowering step-by-step of the plate 81 under the control of the photoelectric cell 97. This latter then, as already stated, besides controlling the maximum level reached by a the strip being deposited before the plate 81 is lowered by a prefixed distance, does also control, acting as a safety device, the raising stroke of the plate 81 during the compacting phase which preceeds the cutting. The photoelectric cell 98, in turn, besides normally controlling this latter operation, does also control the height of the paper sheets which accumulate onto the plate 57 before the assembly of plates 64, 65 penetrates to take its cutting operative position. Lastly the micro-switch 90, i.e. the pair of micro-switches 90, is switched on for controlling the compacting stroke so that the cutting blade operates under the best conditions of compactness of the sheet package formed by the strip 11.

It is important to illustrate the function of the micro-switches 53 when the paper strip passes through a laser printing machine, it undergoes both the action of high temperatures (in the range of 200° C.) and a remarkable mechanical stretching, so that it may occur that during the phase it leaves the dragging device and passes through the guides 36, 37 the strip takes a deformed configuration known as "bourrage (cramming)" namely an irregular bulking. In such a case, in a very short time, the strip may fill in the cage space underliyng the guides 36, 37, with the risk that the strip itself is irremediably damaged and that the apparatus jamming becomes more serious.

The actuation of the micro-switches 53 by the strip will cause both the roller feeding device and the printer to instantaneously stop, so that it is possible to take steps for the restoration of the correct machine operation. In such a case the cylinder 25 by which the raising movement of the stretching roller 15 is controlled, causes a portion of the strip to be set free which is sufficient for the recovery required by the printing machines.

It is further possible and foreseen to modify the apparatus of the invention depending on special requirements.

For example, in conjunction with the entry roller 13, a metallic brush or a similar member may be provided with the purpose of removing the statical electricity possibly carried by the paper.

Similarly, the entering paper strip may be subjected to a certain cooling (by means of air or by passing onto extended metal surfaces) in order to minimize the above mentioned risk of "bourrage".

Moreover, the cage space defined by the bars 38 and 39 may have associated therewith orthogonal panels preferably of the vibrating type, having the purpose of leveling the package being formed.

Instead of the photoelectric cell for controlling the periodical lowering of the plate 81, there may be provided a friction type device, in combination with the folding bladed shafts, acting as a function of and in response to the resistance met by the blades themselves during their rotation.

Lastly, instead of the blade 66 acting like a paperknife device, a blade having a substantially triangular shape can be provided so that the folding to be cut is firstly engaged at a point and not along an extended line.

Moreover, when required by the type of the form strip, the compacting operation of the package being formed onto the plate 81 can be repeated at intervals, without being accompanied by a cutting operation, so that the size regularity of the package and the flattening of the single sheets, forming the strip and accordion-like folded, is much more ensured.

The preceding considerations are not however to be construed as exhausting the further embodiments which are possible and foreseable within the scope of the invention.

I claim:

1. An apparatus for receiving and forming a package of cut piled sheets, the sheet material being received by the apparatus as a continuous strip composed of individual single sheets joined to an adjacent sheet and delineated therefrom by means of separation lines, comprising:

a fixed frame;

roller feeder means supported by said frame upstream thereof for advancing an oncoming continuous strip along a path in a controlled manner;

a sheet receiving plate together with means for the controlled positioning thereof carried by said frame downstream thereof for receiving the sheets after passing through said roller feeder means;

guiding means interposed between said roller feeder means and said sheet receiving plate for receiving, guiding and vertically directing the continuous strips towards said receiving plate on which the individual sheets are piled up in an accordian-like configuration;

means between said guide means and said receiving plate for temporarily holding the strip being piled up onto said receiving plate at a predetermined pile height;

means associated with said guide means for engaging the strip coming from said guide means and for accompanying the strip for the piling up thereof into said accordian-like configuration;

means between said guiding means and said receiving plate for temporarily separating and supporting the strip coming from said guiding means and advancing to said receiving plate, said temporarily separating means including at least one horizontal plate interposable between adjacent strips after leaving said guiding means slidable between a retired position and an operative position;

cutting blade means mounted proximate to said at least one horizontal plate and movable together therewith for engaging one edge formed by the accordian shaped folded strip immediately below said temporarily separating and supporting means, said cutting blade means including a blade movable between a resting position in which said blade does not protrude from said plates and an operative position in which said blade protrudes from said plates;

a driving jack and two rigid bars fastened to said blade, said bars being driven by said jack for the resting and said operative positions;

first detecting means proximate to said roller feeder means for detecting the presence of the strip in said roller feeder means upstream of said apparatus;

second detecting means along said path downstream of said first detecting means for measuring the length of the strip passing through said roller feeder means;

third detecting means associated with said receiving plate for detecting the accumulation level of the strip folded as an accordian onto said receiving plate; and transferring means for the removal of a package of piled sheets from said receiving plate formed after the sheets are separated from the oncoming strip, and formed into packaged piles on an operative surface of said receiving plate.

2. An apparatus according to claim 1, including a plate rigidly secured to the piston stem of said jack, said plate having slots and the free ends of said rigid bars being slidably mounted in said slots, said slots being shaped so that the reciprocating displacement of said stem of said jack and of said plate therewith causes said rigid bars and said blade to be displaced between said two positions.

3. An apparatus according to claim 2, wherein said slots are shaped so that initial advancement of one of said rigid bars is delayed with respect to the corresponding movement of the other of said bars, whereby said blade will take an inclined disposition with respect to its translation direction.

4. An apparatus according to claim 1, wherein said roller feeder means comprises an advancing roller, driving means for actuating said advancing roller and a friction roller in engagement with said advancing roller.

5. An apparatus according to claim 4, including adjustable thrust means for pressing said friction roller against said advancing roller, said thrust means including a double acting cylinder and piston assembly and a pair of bars connected with a rod carrying said friction roller.

6. An apparatus according to claim 4, including a bell crank lever for each said bar fulcrumed to said frame, one end of said bell crank lever being operatively connected to said bar and the other end being secured to a stretching roller parallel to said advancing roller and positioned upstream thereof with reference to the advancement direction of the strip.

7. An apparatus according to claim 6, including a pair of relieved portions between which said one end is slidingly housed.

8. An apparatus according to claim 1, wherein said first detecting means includes a photoelectric cell and a receiver for receiving a beam transmitted by said photocell and positioned such that passing of the strip intercepts the beam emitted by said photoelectric cell, and said second detecting means is a counting device for counting the number of lateral holes provided at the edges of the strip of sheet material.

9. An apparatus according to claim 1, wherein said guide means include a pair of downwardly diverging plates diverging from each other proximate to said roller feeder means starting from an exit position thereof at which the strip leaves the roller feeder means.

10. An apparatus according to claim 1, wherein said means for temporarily holding the strip is a cage of essentially pentagonal shape, said cage being formed by inclined bars and by vertical bars, spaced from each other and defining the opposite sides of said cage.

11. An apparatus according to claim 10, wherein said vertical bars of one side of said cage have secured thereto a swing plate movable between a retired, outwardly rotated position and an operative position which is coplanar with the plane defined by said vertical bars.

12. An apparatus according to claim 10, including means for stopping the apparatus operation mounted to said inclined bars, said stopping means being actuatable upon contacting the strip which is received and piled within said cage.

13. An apparatus according to claim 1, wherein said accompanying means includes two parallel blended shafts, the blades being of flexible material and mounted to said shafts at positioned staggered by a predetermined angle, said blades passing during the rotation of said shaft between said vertical bars.

14. An apparatus according to claim 11, wherein said swing plate is moved between said two positions by a jack mounted to said frame, and having the free end of the piston stem thereof pivoted to said swing plate.

15. An apparatus according to claim 11, including means for temporarily separating the sheets of the pile of folded sheet material positioned above a pair of horizontal plates and acting at one edge of the sheet material, in opposition with reference to said containing cage, with respect to said swing plate.

16. An apparatus according to claim 15, wherein said temporarily separating means for temporarily separating adjacent sheets of the pile of sheets includes a panel movable between an operative position, in which it interferes with the edges or foldings of the sheet material piled up in said containing cage, and a resting or retired position.

17. An apparatus according to claim 15, including a jack fastened to said frame for actuating said panel movable between said operative positions, said jack having a piston stem, the free end thereof being pivotally mounted to said panel.

18. An apparatus according to claim 1, wherein said means for separately and temporarily supporting said strip includes a pair of horizontal plates, said pair of horizontal plates being spaced from each other and movable together as a unit, said plates terminating with an operative chamfered edge so as to fit the folding edge of the sheet material strip being piled up.

19. An apparatus according to claim 18, wherein said cutting blade means is mounted between said two horizontal plates and is movable together therewith.

20. An apparatus according to claim 1, wherein said cutting blade means includes a blade.

21. An apparatus according to claim 18, wherein said cutting blade means is a blade movable between a resting position in which said blade does not protrude from said plates and an operative position in which said blade protrudes from said chamfered edge of said plates.

22. An apparatus according to claim 1, including at least one jack mounted to said plate for controlled raising or lowering thereof.

23. An apparatus according to claim 22, including a curved-shaped flexible panel mounted on said plate, the flexibility of said curved-shaped panel being such that the panel is flattened when pressure applied thereto exceeds a predetermined value, said panel being flattened against the upper surface of said receiving plate.

24. An apparatus according to claim 1, including at least one projecting micro-switch actuatable by a flexible panel upon flattening thereof mounted between said flexible panel and said receiving plate.

25. An apparatus according to claim 1, wherein said transfer means includes an arm transversely movable with respect to said receiving plate when said receiving plate is at its lowermost position between a resting position and a transfer position.

26. An apparatus according to claim 1, wherein said third level detecting means includes two vertically aligned photoelectric cells, one of said photocells being mounted in alignment with said cutting blade means and the other of said photocells being aligned with a standard level position above that of said photoelectric cell.

27. An apparatus for receiving and forming a package of cut piled sheets, the sheet material being received by the apparatus as a continuous strip composed of individual single sheets joined to an adjacent sheet and delineated therefrom by means of separation lines, comprising:

a fixed frame;

roller feed means supported by said frame upstream thereof for advancing an oncoming continuous strip along a path in a controlled manner;

a sheet receiving plate together with means for the controlled positioning thereof carried by said frame downstream thereof for receiving the sheets after passing through said roller feed means;

guiding means interposed between said roller feed means and said sheet receiving plate for receiving and vertically directing the continuous strips towards said receiving plate for piling up the individual sheets in an accordian-like configuration;

means between said guide means and said receiving plate for temporarily holding the strip being piled up onto said receiving plate at a predetermined pile height;

means associated with said guide means for engaging the strip coming from said guide means and for accompanying the strip for the piling up thereof into said accordian-like configuration;

means between said guiding means and said receiving plate for temporarily separating and supporting the strip coming from said guiding means and advancing to said receiving plate, said temporarily separating means including separation plate means interposable between adjacent strips after leaving said guiding means;

cutting blade means for engaging one edge formed by the accordian shaped folded strip immediately below said temporarily separating and supporting means;

at least one jack mounted to said plate for controlled raising and lowering thereof, said jack raising said plate until it contacts said temporarily separating means;

first detecting means proximate to said roller feed means and along said path upstream of said advancing roller for detecting the presence of the strip in said roller feed means;

second detecting means along said path downstream of said first detecting means for measuring the length of the strip passing through said roller feed means;

third detecting means associated with said receiving plate for detecting the accumulation level of the strip folded as an accordian onto said receiving plate and controlling the height of the pile of sheets;

transferring means for the removal of a package of piled sheets from said receiving plate formed after the sheets are separated from the oncoming strip, and formed into packaged piles on an operative surface of said receiving plate; and a driving jack and two rigid bars fastened to said cutting blade means, said bars being driven by said jack for the resting and the operative positions.

28. An apparatus according to claim 27, wherein said means for separately and temporarily supporting said strip include at least one horizontal plate slidable between a retired position and an operative position, and said cutting blade means is mounted proximate to said at least one horizontal plate and is movable together with said plate.

29. An apparatus according to claim 8, wherein said cutting blade means is a blade movable between a resting position in which said blade does not protrude from said at least one horizontal plate and an operative position in which said blade protrudes from a chamfered edge of said plate.

30. An apparatus according to claim 27, including a plate rigidly secured to the piston stem of the jack, said plate having slots and the free ends of said rigid bars being slidably mounted in said slots, said slots being shaped so that the reciprocating displacement of said stem of said jack and of said plate therewith causes said rigid bars and said blade to be displaced between said two positions.

31. An apparatus according to claim 30, wherein said slots are shaped so that initial advancement of one of said rigid bars is delayed with respect to the corresponding movement of the other of said bars, whereby said blade will take an inclined disposition with respect to its translation direction.

* * * * *